United States Patent [19]

Cruz

[11] 4,102,159

[45] Jul. 25, 1978

[54] WASHING MACHINE

[75] Inventor: Herbert Cruz, Los Angeles, Calif.

[73] Assignee: The Raymond Lee Organization, Inc., New York, N.Y.

[21] Appl. No.: 774,795

[22] Filed: Mar. 7, 1977

[51] Int. Cl.[2] ..... D06F 13/02; D06F 39/08

[52] U.S. Cl. ..... 68/132; 68/208; 134/115 R

[58] Field of Search ..... 68/3 R, 4, 13 R, 132, 68/137, 208, 232, 233; 134/115 R, 115 G; 4/1, 178, 187 R

[56] References Cited

U.S. PATENT DOCUMENTS 1,839,663 1/1932 Fehn ..... 68/208 X

FOREIGN PATENT DOCUMENTS 501,905 11/1954 Italy ..... 68/132

495,657 11/1938 United Kingdom ..... 68/3 R

*Primary Examiner*—Philip R. Coe

*Attorney, Agent, or Firm*—Howard I. Podell

[57] ABSTRACT

A washing machine mechanism adaptable for installation in the wash facilities of homes occupied by low income families of developing countries and particularly adaptable for installation in the wash tub units of Central and South America. The mechanism incorporates a propeller which mounts in a bearing in the drain of a wash sink with a motor unit mounted above the propeller and joined by a vertical shaft to the propeller and by a horizontal shaft to a pair of rollers mounted above an adjacent drain area. The propeller rotates in a bushing cup, slidably mounted in the sink drain, with a lever joined to the bushing to move the bushing into a first position in which the drain is plugged or a second position in which the drain is open.

2 Claims, 4 Drawing Figures

FIG. 1
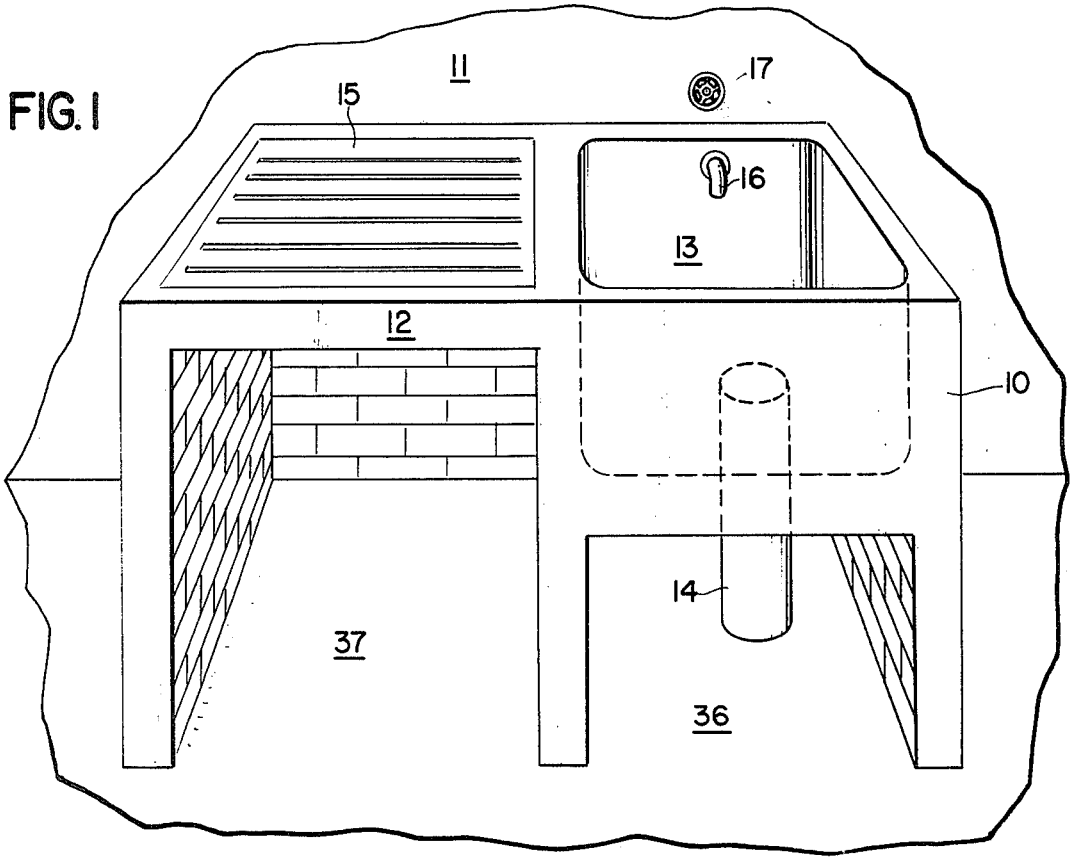
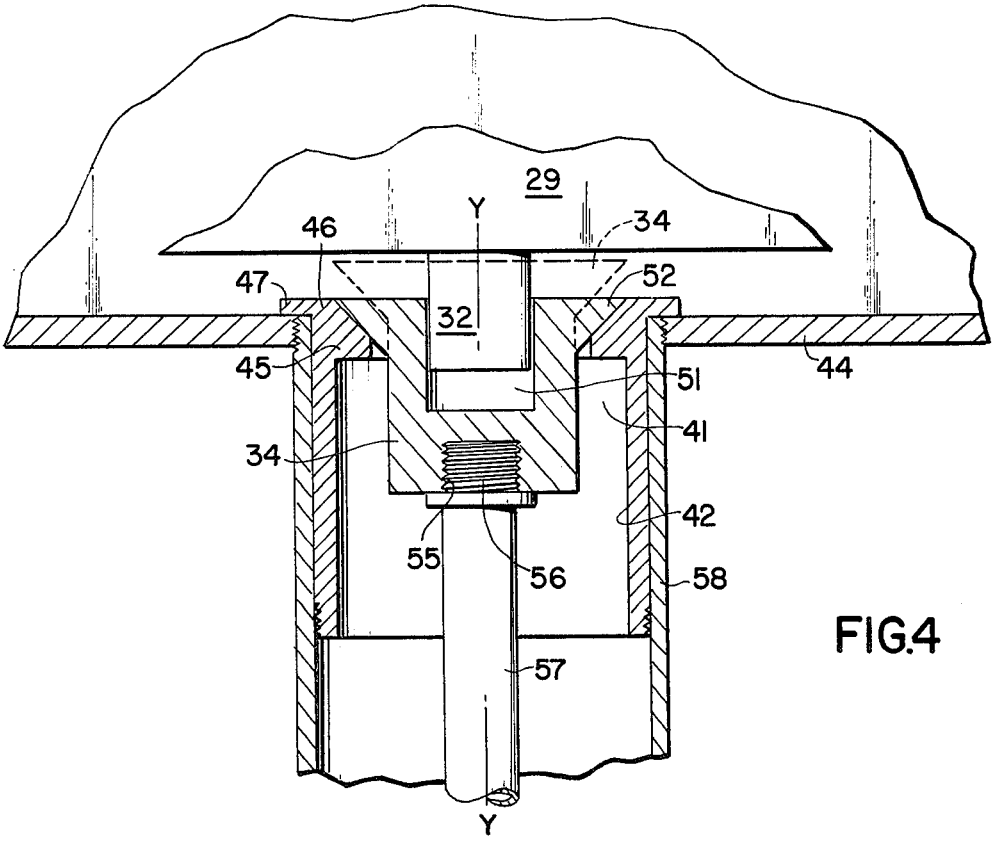
FIG. 4

WASHING MACHINE

SUMMARY OF THE INVENTION

My invention is a washing machine mechanism adaptable for intallation in the wash facilities of homes occupied by low income families of developing countries and particularly adaptable for installation in the wash tub units of Central and South America.

The mechanism incorporates a propeller which mounts in a bearing in the drain of a wash sink with a motor unit mounted above the propeller and joined by a vertical shaft to the propeller and by a horizontal shaft to a pair of rollers mounted above an adjacent drain area.

The propeller rotates in a bushing cup, slidably mounted in the sink drain, with a lever joined to the bushing to move the bushing into a first position in which the drain is plugged or a second position in which the drain is open.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of a typical wash unit, prior to installation of the invention;

FIG. 4 is an exploded detail view of the drain bushing assembly.

DESCRIPTION OF THE PREFERRED EMBODIMENT

Figure 2:
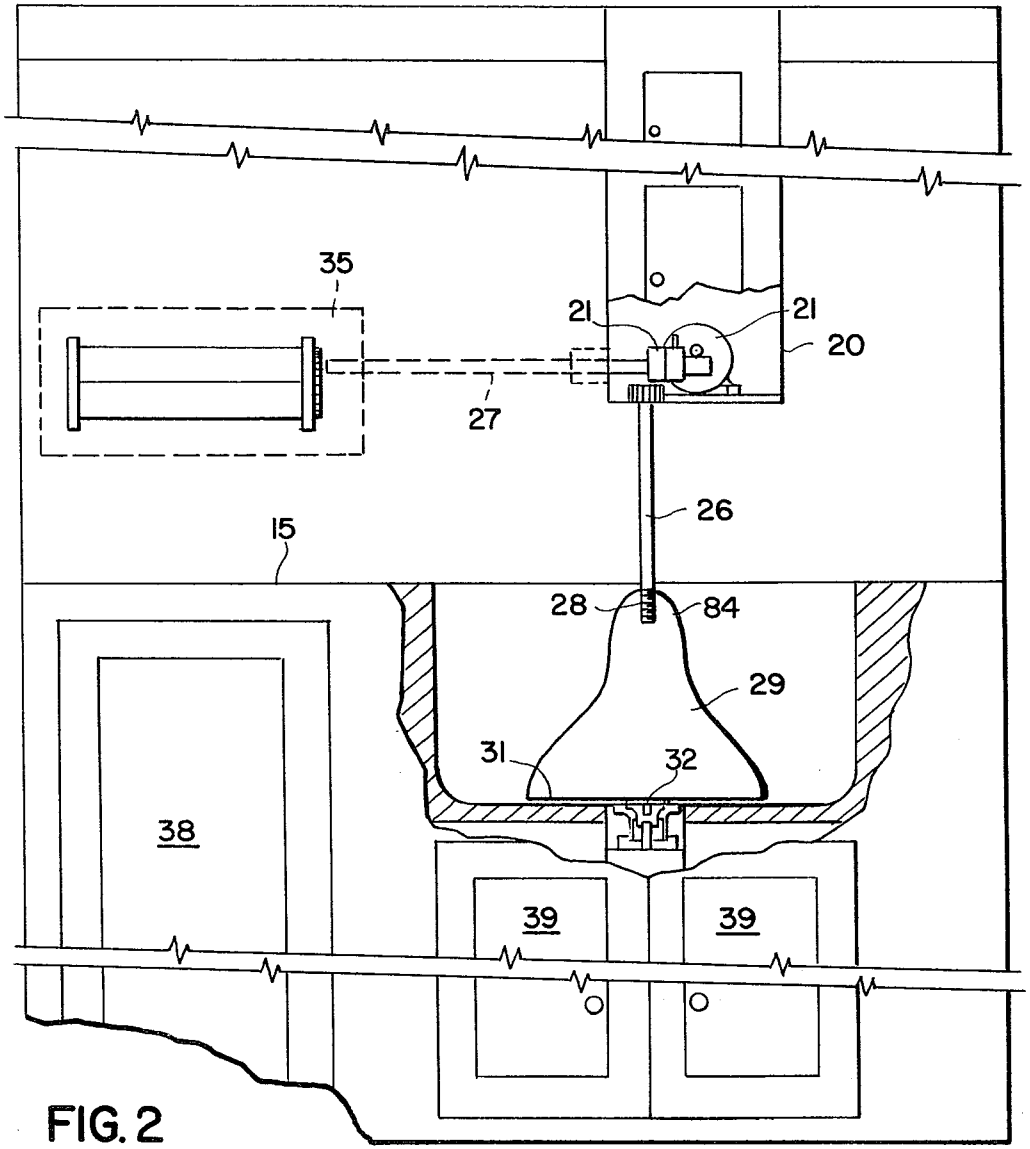
FIG. 2 is an elevation view of the invention installed.

Turning now descriptively to the drawings, in which similar reference characters denote similar elements throughout the several views, FIG. 1 illustrates a conventional wash unit 10 of the type conventionally employed in low income family homes of the developing countries and particularly found in Mexico, Central and South America and the Caribbean area.

Figure 3:
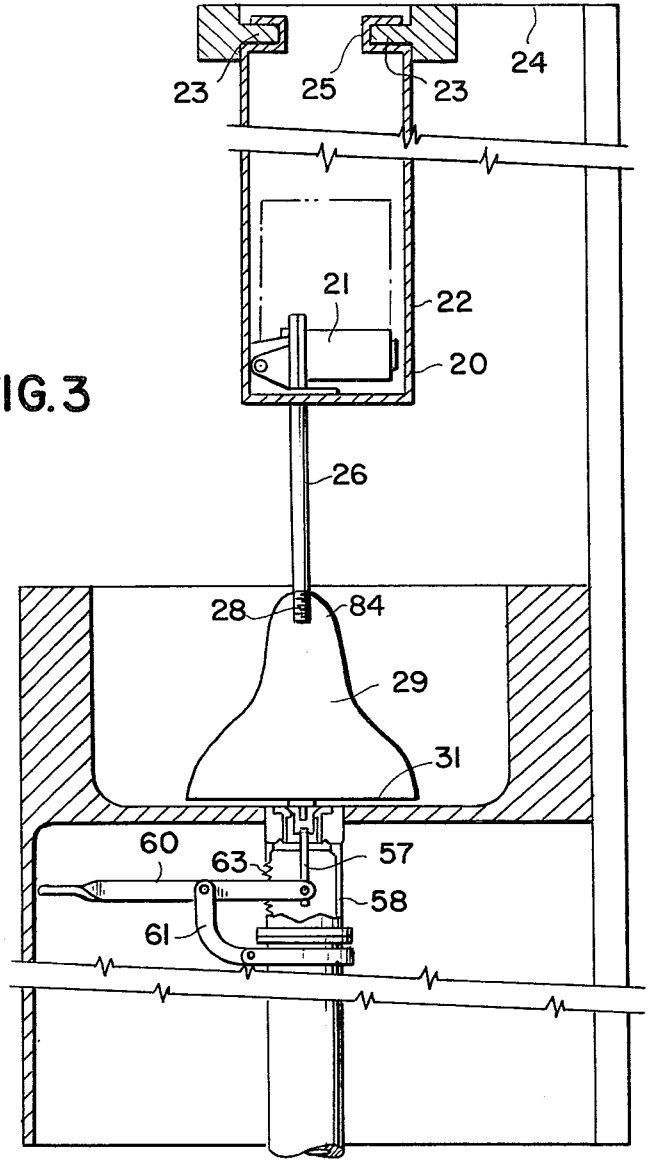
FIG. 3 is an end sectional view of the invention.

FIGS. 2–4 illustrate the washing machine 20 of the invention which may be readily installed in such wash units 10.

The wash unit 10 is generally mounted against a tile wall 11 and consists of an open concrete or brick housing 12, in one side of which a sink 13 is joined to a vertical drain pipe 14, with the other side fitted with a drain board 15 mounted over an open area 37, with drain board 15 fitted with drainage means (not shown) joined to sink 13. A faucet 16 controlled by a valve 17 may be mounted above sink 13.

As shown in FIGS. 2–3, the washing machine 20 consists of a gear motor unit 21 housed in an enclosure 22 slidably suspended by spaced ribs 23 fixed to the ceiling 24, with the enclosure 22 formed with shaped flanges 25 that slidably engage ribs 23. Ribs 23 are oriented along lines parallel to the transverse axis of the wash unit 10.

Gear motor 21 is fitted with a vertical output shaft 26 which is detachably joined at its lower end 28 to the top 84 of a propeller 29 located in the sink 13, with propeller 29 concentrically fitted at its lower end 31 with a shaft 32 which rides in a bushing cup 34. A horizontal output shaft 27 may be detachably fitted to gear motor 21 for powering a drain roller unit 35 that may be suitably suspended over drain board 15.

Cabinet doors 38 and 39 may be pivotably mounted flush in the vertical openings of the drain area 37 and the vertical opening 36 below the sink 13 respectively.

As shown in FIG. 4, the drain opening 41 in the bottom 44 of sink 13 is fitted with an attachable vertical tube 42 that extends above the bottom 44 of the sink and is formed with a tapered internal lip 45 along its top rim 46 and fitted with an external flange 47 about rim 46 for sealing to the periphery of drain opening 41.

Bushing cup 34 is shaped with a blind internal cylindrical hole 51 along the vertical axis Y—Y of cup 34 of an internal diameter to rotatably engage shaft 32 of propeller 29, with hole 51 open to the top of bushing cup 34. The lower section of cup 34 is of an outer diameter to freely fit inside of tube 42 and internal lip 45, with cup 34 fitted with an external tapered flange 52 of a size to mate with internal lip 45 of tube 42 when cup 34 is seated on lip 45, so as to seal the drain opening 41.

A blind threaded hole 55 extends along vertical axis Y—Y from the bottom of cup 34, of a size to engage the male thread 56 of rod 57 which is mounted inside of tube 42 and inside of drain pipe 58 joined to the bottom of drain opening 41.

The shaft 32 of propeller 29 is slidably suspended in bushing cup 34 by vertical motor output shaft 26 to permit free vertical motion of bushing cup 34 from a first seated position to a second unseated position about lip 45 of tube 42 in response to vertical motion of rod 57.

A lever 60 is pivotably bolted to rod 57 and pivotably bolted to a clamp support arm 61 fitting about drain pipe 58, with lever 60 extending through a side opening in drain pipe 58 which is sealed by a flexible gasket 63 so that rotation of lever 60 serves to seat or unseat bushing cup 34 about drain opening 41.

As described, my invention may be readily installed in an existing sink to provide both motorized agitation of wash water in the sink and rolling of washed material through motorized rollers.

Motor 21 may be fitted with gear mechanism to provide reciprocal motion of propeller 29 and uniform motion of the rollers of roller unit 35.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A washing machine unit adaptable for installation in an open sink comprising a motorized unit fitted with suspension means for mounting above a sink, a propeller joined concentrically at an upper section of the propeller by a first shaft to the motorized unit, a bushing cup mountable in the drain opening of the sink, said propeller fitted with a second shaft extending concentrically from a lower section of the propeller into the bushing cup, said bushing cup formed of a body section of a lesser external size in cross-section than the cross-sectional size of the said drain opening, with an external flange extending about the upper periphery of said body section of an external cross-sectional size and shape to close said drain opening when the said flange rests on the upper periphery of said drain opening, with said bushing cup formed with a blind cylindrical hole extending from the upper surface of the bushing cup along the vertical axis of said bushing cup, said hole of a depth and cross-section to freely slidably fit about the lower section of said second shaft both with the bushing cup in a first position in which the bushing cup flange rests on the upper periphery of said drain opening and with the bushing cup in a second position in which the bushing cup and said flange is elevated so that the flange is spaced above the upper periphery of the drain opening, such that the bushing cup serves both as a bearing to the lower section of the second shaft and as a slidable valve seat for closing or opening the drain opening, together with lever means for moving the bushing cup along the axial direction of the second shaft from said first position to said second position, said lever means serving to hold the bushing cup in place.

2. The combination as recited in claim 1 in which the drain opening is bounded by a hollow sleeve detachably mounted in a drain pipe leading from the sink, with the upper periphery of said sleeve formed with a tapered internal lip, and the lower periphery of said flange of the bushing cup is externally shaped in mating configuration to said tapered lip of the sleeve.

* * * * *